US012392549B2

(12) United States Patent
Ducote, Jr.

(10) Patent No.: US 12,392,549 B2
(45) Date of Patent: Aug. 19, 2025

(54) GAS STREAM COMPONENT REMOVAL SYSTEM AND METHOD

(71) Applicant: Chart Energy & Chemicals, Inc., Ball Ground, GA (US)

(72) Inventor: Douglas A. Ducote, Jr., The Woodlands, TX (US)

(73) Assignee: Chart Energy & Chemicals, Inc., Ball Ground, GA (US)

( * ) Notice: Subject to any disclaimer, the term of this patent is extended or adjusted under 35 U.S.C. 154(b) by 90 days.

(21) Appl. No.: 17/336,987

(22) Filed: Jun. 2, 2021

(65) Prior Publication Data

US 2021/0381757 A1 Dec. 9, 2021

Related U.S. Application Data

(60) Provisional application No. 63/034,112, filed on Jun. 3, 2020.

(51) Int. Cl.
*F25J 1/00* (2006.01)
*F25J 1/02* (2006.01)

(52) U.S. Cl.
CPC ..... *F25J 1/0022* (2013.01); *F25J 1/0225* (2013.01); *F25J 1/0238* (2013.01); *F25J 1/0283* (2013.01); *F25J 2210/60* (2013.01); *F25J 2220/60* (2013.01); *F25J 2240/02* (2013.01)

(58) Field of Classification Search
CPC ..... F25J 1/0238; F25J 1/0225; F25J 1/0022; F25J 1/0292; F25J 3/06; F25J 3/065; F25J 3/0645; F25J 3/0655; F25J 3/0209; F25J 3/0214; F25J 3/0252; F25J 2205/40;
(Continued)

(56) References Cited

U.S. PATENT DOCUMENTS 3,791,157 A 2/1974 Tracy et al.
3,910,063 A 10/1975 Prast
5,291,736 A 3/1994 Paradowski
(Continued)

FOREIGN PATENT DOCUMENTS

CN 104685036 B 7/2017
EP 109293 B1 6/2004
(Continued)

OTHER PUBLICATIONS

International Search Report and Written Opinion Dated Nov. 17, 2021 for International Application No. PCT/US2021/0696.02.
(Continued)

*Primary Examiner* — Brian M King
(74) *Attorney, Agent, or Firm* — Cook Alex Ltd.

(57) ABSTRACT

A system for removing selected components from a gas stream has a heat exchanger including a first cooling passage configured to receive a feed gas stream and to provide a cooled feed gas stream. An expander receives at least a portion of the cooled feed gas stream. A separation device receives an expanded fluid stream from the expander and separates the expanded fluid stream into a liquid stream containing selected components and a purified vapor stream having a purified vapor temperature. A compressor receives the purified vapor stream at approximately the purified vapor temperature and produces a compressed vapor stream that is returned to the heat exchanger.

35 Claims, 5 Drawing Sheets

(58) Field of Classification Search
CPC .. F25J 2205/82; F25J 2210/06; F25J 2220/42; F25J 1/0237; F25J 1/0239
See application file for complete search history.

(56) References Cited

U.S. PATENT DOCUMENTS

| | | | | |
|---|---|---|---|---|
| 5,799,507 | A * | 9/1998 | Wilkinson | F25J 3/0233 62/619 |
| 6,109,061 | A * | 8/2000 | Gaskin | F25J 3/0233 62/621 |
| 6,216,467 | B1 | 4/2001 | O'Neil et al. | |
| 6,250,105 | B1 | 6/2001 | Kimble | |
| 6,367,286 | B1 | 4/2002 | Price | |
| 7,010,937 | B2 | 3/2006 | Wilkinson et al. | |
| 2003/0089125 | A1 | 5/2003 | Fredheim et al. | |
| 2003/0177785 | A1 | 9/2003 | Kimble et al. | |
| 2007/0022760 | A1 | 2/2007 | Billman | |
| 2009/0293537 | A1* | 12/2009 | Ameringer | F25J 3/0233 62/620 |
| 2010/0043488 | A1* | 2/2010 | Mak | F25J 3/0233 62/620 |
| 2011/0048067 | A1* | 3/2011 | Fischer | F25J 1/0292 62/620 |
| 2016/0313056 | A1* | 10/2016 | Kikkawa | F25J 1/0216 |
| 2017/0089638 | A1 | 3/2017 | Valencia et al. | |
| 2018/0347901 | A1 | 12/2018 | Groenendijk et al. | |
| 2019/0086146 | A1* | 3/2019 | Ducote, Jr. | F25J 1/0212 |
| 2019/0204007 | A1 | 7/2019 | Douglas, Jr. et al. | |
| 2020/0370824 | A1* | 11/2020 | Mak | F25J 3/0238 |

FOREIGN PATENT DOCUMENTS

| | | | |
|---|---|---|---|
| FR | 2286122 | A1 | 4/1976 |
| TW | 201930799 | A | 8/2019 |
| WO | 9614547 | A1 | 5/1996 |
| WO | 9713109 | A1 | 4/1997 |
| WO | 9859205 | A2 | 12/1998 |
| WO | 9859206 | A1 | 12/1998 |
| WO | 0188447 | A1 | 11/2001 |
| WO | 2016179115 | A1 | 11/2016 |
| WO | 2017093381 | A1 | 6/2017 |
| WO | 2019075206 | A1 | 4/2019 |

OTHER PUBLICATIONS

Song, et al., "Natural gas purification by heat pump assisted MEA absorption process." Applied Energy 204 (2017): 353-361. [Abstract Only].

Office Action Dated Nov. 19, 2024 for Taiwan Patent Application No. 110120292 (24 Pages).

Office Action, counterpart Japanese App. No. 2022-574388 (Apr. 2, 2025) (4 Pages).

* cited by examiner

GAS STREAM COMPONENT REMOVAL SYSTEM AND METHOD

CLAIM OF PRIORITY

This application claims the benefit of U.S. Provisional Application No. 63/034,112, filed Jun. 3, 2020, the contents of which are hereby incorporated by reference.

FIELD OF THE DISCLOSURE

The present invention relates generally to systems and methods for cooling or liquefying gases and, more particularly, to a system and method for removing selected components from such gases.

BACKGROUND

Natural gas is often liquefied under pressure for storage, use and transport. The reduction in volume that results from liquefaction permits containers of more practical and economical design to be used.

Natural gas is typically obtained from underground reservoirs via drilling or similar operations. The resulting natural gas streams, while primarily methane, may contain components such as heavy hydrocarbons (including, for example, butane, ethane, pentane and propane, benzenes, xylenes, heptanes, octanes and heavier components), carbon dioxide, hydrogen, nitrogen and water.

Liquefaction is typically accomplished by chilling the natural gas through indirect heat exchange by one or more refrigeration cycles in one or more heat exchangers. If components such as heavy hydrocarbons are present in a gas stream during liquefaction, such components may freeze and impair operation of the liquefaction heat exchanger. It also may be desirable to recover components as products. In addition, liquid natural gas of higher purity produces less greenhouse gases such as carbon dioxide when it is burned as a fuel.

SUMMARY OF THE DISCLOSURE

There are several aspects of the present subject matter which may be embodied separately or together in the methods, devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto In one aspect, a system for removing selected components from a gas stream includes a heat exchanger having a first cooling passage configured to receive a feed gas stream and to provide a cooled feed gas stream. An expander is configured to receive at least a portion of the cooled feed gas stream. A separation device is configured to receive an expanded fluid stream from the expander and to separate the expanded fluid stream into a liquid stream containing selected components and a purified vapor stream having a purified vapor temperature. A compressor is configured to receive the purified vapor stream at approximately the purified vapor temperature and to produce a compressed vapor stream that is returned to the heat exchanger.

In another aspect, a system for liquefying a feed gas includes a heat exchanger having a first cooling passage and a second cooling passage. The first cooling passage is configured to receive a feed gas stream so that a cooled feed gas stream is formed. A mixed refrigerant compression system is in communication with the heat exchanger and configured to cool the first and second cooling passages. A liquefied gas outlet line is connected to an outlet of the second cooling passage. An expander is configured to receive at least a portion of the cooled feed gas stream from the first cooling passage. A separation device is configured to receive an expanded fluid stream from the expander and to separate the expanded fluid stream into a liquid stream containing selected components and a purified vapor stream having a purified vapor temperature. A compressor is configured to receive the purified vapor stream at approximately the purified vapor temperature and to produce a compressed vapor stream. The second cooling passage is configured to receive and liquefy the compressed vapor stream.

In still another aspect, a process is provided for removing selected components from a gas stream and includes the steps of cooling a feed gas stream to provide a cooled feed gas stream, expanding the cooled feed gas stream to provide an expanded gas stream, separating the expanded gas stream into a liquid stream containing selected components and a purified vapor stream having a purified vapor temperature; and compressing the purified vapor stream to provide a compressed vapor stream.

In yet another aspect, a method of liquefying a gas feed stream includes the steps of cooling a gas feed gas stream to provide a cooled feed gas stream, expanding the cooled feed gas stream to provide an expanded gas stream, separating the expanded gas stream into a liquid stream containing selected components and a purified vapor stream having a purified vapor temperature, compressing the purified vapor stream to provide a compressed vapor stream and cooling the compressed vapor stream to form a liquefied gas stream.

DETAILED DESCRIPTION OF EMBODIMENTS

Mixed refrigerant liquefaction systems and methods including embodiments of the component removal system of the disclosure are illustrated in FIGS. 1-5. It should be noted that while the embodiments are illustrated and described below in terms of systems for removing freezing components and liquefying natural gas to produce liquid natural gas, the technology of the disclosure may be used with systems that liquefy or cool other types of gases. In addition, the technology of the disclosure may be used to perform separation of any selected components that freeze or condense out at temperatures warmer that the final desired liquid natural gas or other product temperature, but colder than the inlet temperature of the gas stream.

Figure 1:
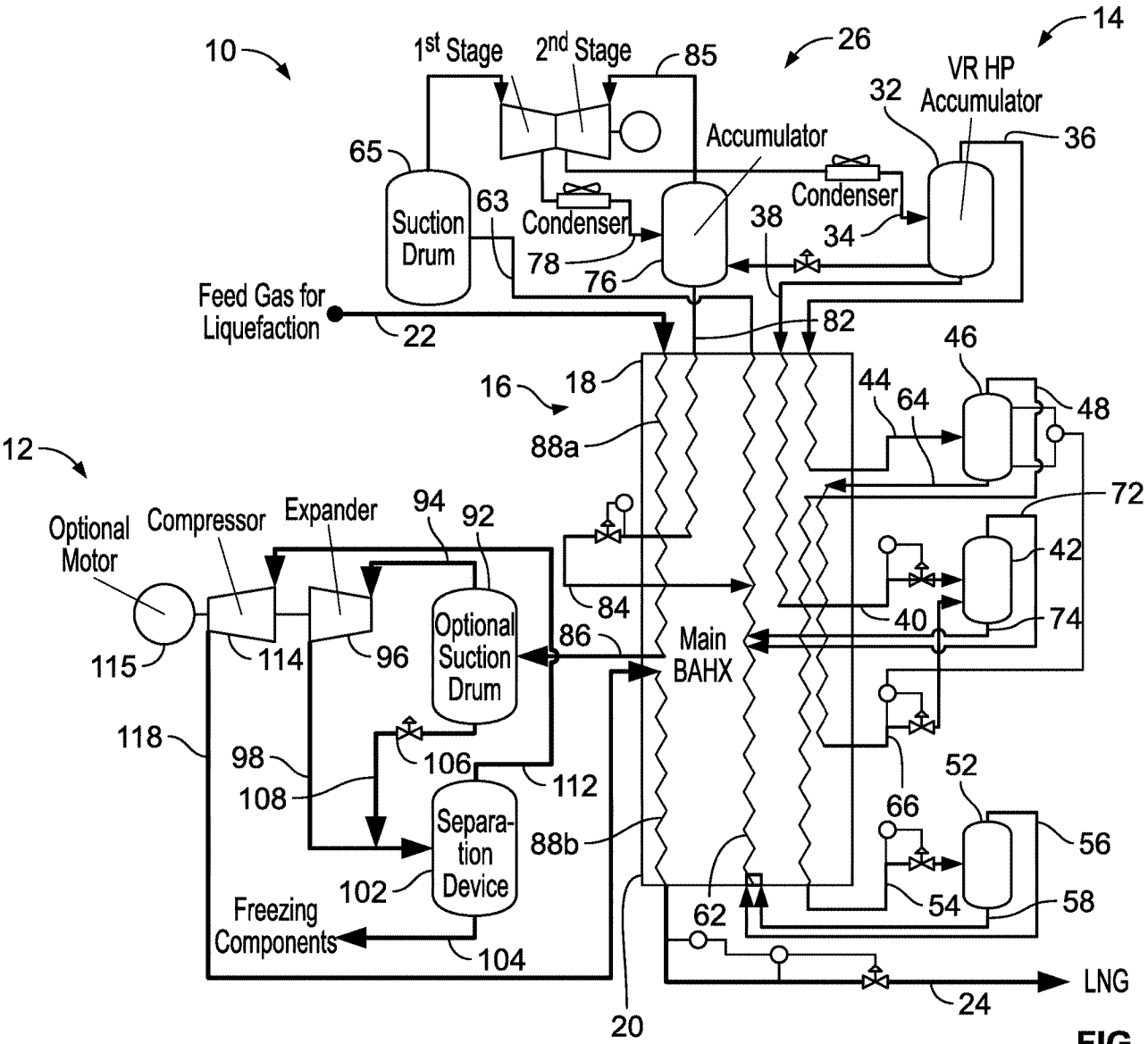
FIG. 1 is a process flow diagram and schematic illustrating a first embodiment of the system of the disclosure.

With reference to FIG. 1, a system including an embodiment of the component removal system of the disclosure is indicated in general at 10. The system includes a selected component removal system, indicated in general at 12 integrated into a liquefaction system, indicated in general at 14. The basic liquefaction system, including a mixed refrigerant compressor system, may be, as examples only, as described in commonly owned U.S. Pat. No. 9,441,877 to Gushanas et al. or U.S. Pat. No. 10,480,851 to Ducote, Jr. el., the contents of each of which are hereby incorporated by reference.

Generally, with reference to FIG. 1, the system includes a multi-stream main heat exchanger, indicated in general at 16, having a warm end portion 18 and a cold end portion 20. The heat exchanger receives a high pressure natural gas feed stream 22 that is cooled and liquefied in the main heat exchanger via removal of heat via heat exchange with refrigeration streams. As a result, a product stream 24 of liquid natural gas (LNG) is produced. The multi-stream design of the heat exchanger allows for convenient and energy-efficient integration of several streams into a single heat exchanger. Suitable heat exchangers, such as a brazed aluminum heat exchanger (BAHX), may be purchased from Chart Energy & Chemicals, Inc. of Ball Ground, Georgia. The plate and fin multi-stream heat exchanger available from Chart Energy & Chemicals, Inc. offers the further advantage of being physically compact.

Alternative designs and types of heat exchangers may be substituted for the BAHX illustrated at 16 in FIG. 1.

The system of FIG. 1, including heat exchanger 16, may be configured to perform other gas processing options known in the art. These processing options may require the gas stream to exit and reenter the heat exchanger one or more times and may include, as described in further detail below, selected component removal and natural gas liquids recovery.

The removal of heat is accomplished in the heat exchanger using a mixed refrigerant that is processed and reconditioned using a mixed refrigerant compressor system indicated in general at 26. The mixed refrigerant compressor system includes a high pressure accumulator 32 that receives and separates a mixed refrigerant (MR) mixed-phase stream 34 after a last compression and cooling cycle. While an accumulator drum 32 is illustrated, alternative separation devices may be used, including, but not limited to, another type of vessel, a cyclonic separator, a distillation unit, a coalescing separator or mesh or vane type mist eliminator. High pressure vapor refrigerant stream 36 exits the vapor outlet of the accumulator 32 and travels to the warm end portion 18 of the heat exchanger 16.

High pressure liquid refrigerant stream 38 exits the liquid outlet of accumulator 32 and also travels to the warm end of the heat exchanger. After cooling in the heat exchanger, it travels as mixed phase stream 40 to mid-temp standpipe 42.

After the high pressure vapor stream 36 from the accumulator 32 is cooled in the heat exchanger 16, a mixed phase stream 44 flows to a cold vapor separator 46. A resulting vapor refrigerant stream 48 exits the vapor outlet of the separator 46 and, after cooling in the heat exchanger 16, travels to cold temperature standpipe 52 as mixed-phase stream 54. Vapor and liquid streams 56 and 58 exit the cold temperature standpipe 52 and feed into the primary refrigeration passage 62 at the cold end 20 of the heat exchanger 16.

A vaporized mixed refrigerant stream 63 exits the warm end 18 of the heat exchanger and, after passing through an optional suction drum 65, is directed to the inlet of a compressor of an initial compression and cooling cycle.

A liquid stream 64 exits the cold vapor separator 46, is cooled in heat exchanger 16 and exits the heat exchanger as mixed-phase stream 66. Mixed phase stream 66 is directed to the mid-temp standpipe 42 and combined with the mixed phase stream 40 from the liquid outlet of accumulator 32. Vapor and liquid streams 72 and 74 exit the mid-temp standpipe and feed into the primary refrigeration passage 62 as illustrated.

An interstage separation device 76 receives and separates a mixed refrigerant mixed-phase stream 78 after the initial compression and cooling cycle. While a separation drum 76 is illustrated, alternative separation devices may be used, including, but not limited to, another type of vessel, a cyclonic separator, a distillation unit, a coalescing separator or mesh or vane type mist eliminator. A liquid stream 82 exits the liquid outlet of the interstage separation device, is cooled in heat exchanger 16, and the resulting stream 84 is expanded and directed to the primary refrigeration passage 62. A vapor stream 85 exits a vapor outlet of the interstage separation device and travels to the last compression and cooling cycle of the compression system. In alternative embodiments of the system, the interstage separation device may include only a vapor outlet, or it may be eliminated entirely.

In accordance with the disclosure, the component removal system 12 receives a cooled gas feed stream 86, which is produced by cooling feed gas stream 22 in a first cooling passage 88*a* of the main heat exchanger 16.

Cooled feed gas stream 86, after withdrawal from the main heat exchanger 16, is directed to an optional suction drum 92. A vapor stream 94 from the suction drum travels to an expander 96, which is preferably an expansion turbine, so that the gas stream pressure is reduced below the critical pressure. This causes the components that would freeze and/or other components that would condense in the main heat exchanger to condense so that a mixed-phase stream 98 is formed. This mixed-phase stream 98 travels to a separation device 102, where a liquid stream 104 containing the condensed freezing components and other selected components is withdrawn from the bottom.

While an expansion turbine is illustrated as the expander 96, alternative expansion devices including, but not limited to, expansion valves or orifices could be used.

Any liquid collected in the suction drum 92 may be directed to the mixed phase stream 98 traveling to the separation device by opening a drain valve 106 in a liquid drain line 108 exiting the bottom of the suction drum. This prevents potential damage to the expander 96. Alternatively, the liquid from the suction drum may go directly into the separation device 102 after exiting valve 106.

As indicated above, the suction drum 92, and thus liquid line 108 and drain valve 106, is optional and thus may be omitted with the feed stream withdrawn from the main heat exchanger being routed directly to the inlet of the expander 96. Or, in an alternative embodiment, the stream routed to the inlet of the expander 96 may be slightly heated (such as by a passage through a portion of the heat exchanger 16 or a dedicated heat exchanger) to vaporize any liquid in the stream or hot gas bypass of the feed gas.

A purified methane-rich vapor stream 112 exits the top of the separation device 102 at a purified vapor temperature and is directed to a compressor (or compressors) 114, which may be powered by the expander 96 (in versions of the system where the expander is a turbine) or a motor 115, or a combination of both. Use of the expander to power the compressor recovers energy from the high pressure gas stream received by the expander.

The ideal pressure for optimal efficiency for the stream returning to the heat exchanger for liquefaction (the "return pressure") is a pressure corresponding to a temperature (the "return temperature") that is nearly equal to the temperature of the suction drum or stream exiting heat exchanger passage 88*a*. By receiving the vapor stream 112 at the purified vapor temperature (or at approximately the purified vapor temperature due to potential incidental warming of the purified vapor stream as it flows from the separation device 102 to the compressor inlet), the compressor 114 "cold compresses" the vapor stream 112 to a higher pressure and a temperature, where the temperature of the compressed stream is approximately equal to or slightly below the temperature of the vapor in the suction drum 92 or the cooled gas stream 86 withdrawn from the main heat exchanger. The return temperature of the vapor stream 118 exiting the compressor is ideally near or below the temperature of the gas in the suction drum 92 (or stream 86) because the system does not heat the vapor exiting the separation device 102 prior to entry into the compressor 114. Furthermore, by having cold vapor enter the compressor 114, the pressure of the vapor exiting the compressor is higher and the temperature is lower than if the vapor from the separation device 102 was heated prior to entry into the compressor (for the same compressor power level). As a result, the refrigeration power required for a given level of liquid natural gas production is reduced or, conversely, a higher liquid natural gas production is obtained if the refrigeration power is fixed. The compressed vapor stream 118 is returned to a second cooling passage 88*b* of the heat exchanger 16 at a return pressure and a return temperature to be liquefied so that LNG product stream 24 is produced.

While first and second cooling passages 88*a* and 88*b* of FIG. 1 are illustrated as being part of a single heat exchanger 16, in alternative embodiments, the passages 88*a* and 88*b* may be incorporated into separate heat exchangers that are arranged in series. In addition, passages running parallel to passage 88*a* may be formed in the same or in additional heat exchangers. The same applies for passage 88*b* (and for passages corresponding to passages 88*a* and 88*b* in the remaining embodiments)

The process shown is for a natural gas liquefaction process, however, the system and process illustrated at 12 may be used with any other process that requires separating at least part of the incoming feed gas at a lower pressure and temperature and benefits from returning the feed gas at a higher pressure.

Figure 2:
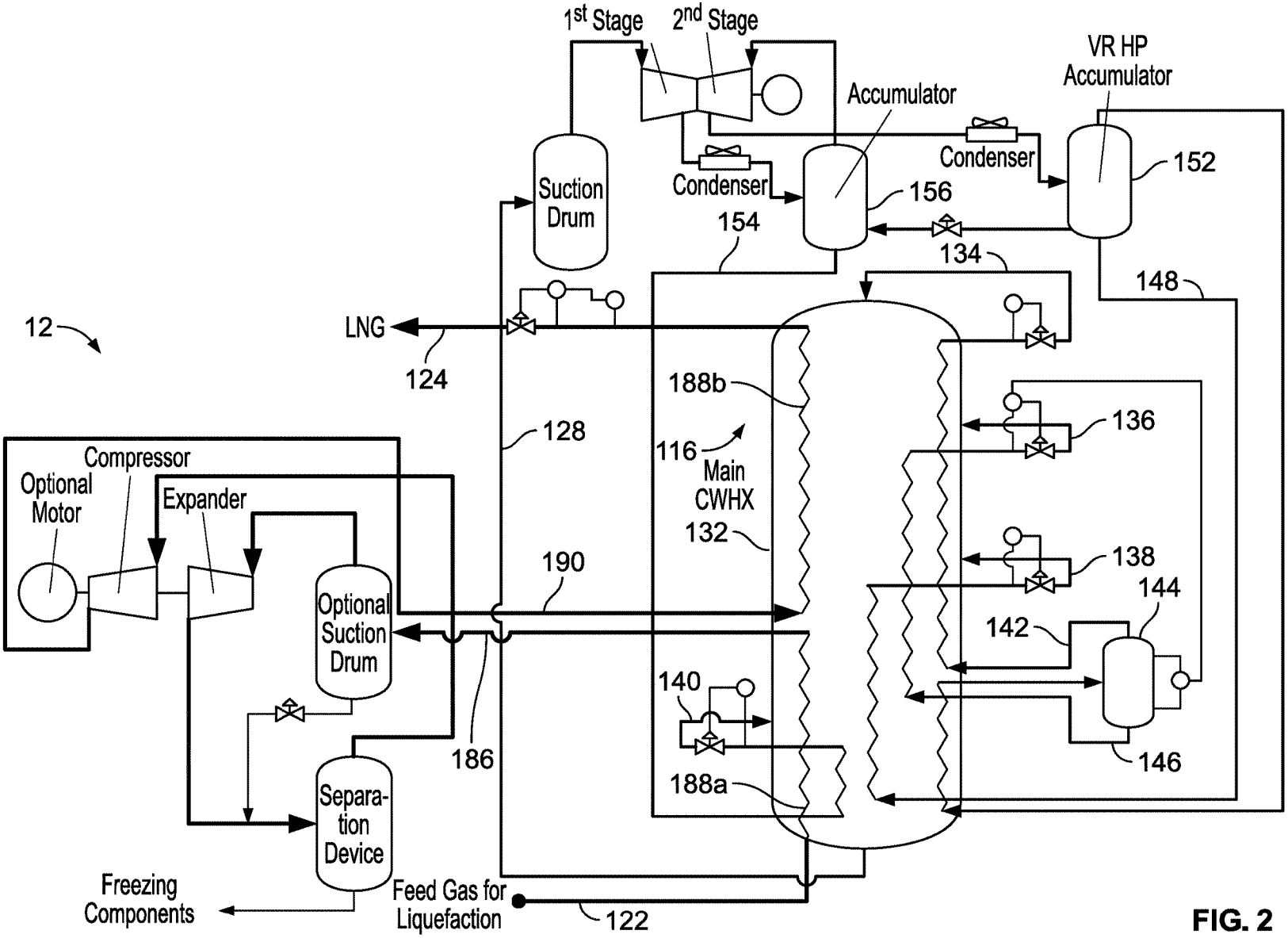
FIG. 2 is a process flow diagram and schematic illustrating a second embodiment of the system of the disclosure.

As illustrated in FIG. 2, the component removal system 12 of FIG. 1 may be implemented as part of a liquefaction process that uses a coil wound heat exchanger (CWHX), indicated in general at 116. Such heat exchangers are well known in the art and, as examples only, may be purchased from Linde plc of Dublin, Ireland, or Air Products and Chemicals, Inc. of Allentown, Pennsylvania.

As illustrated in FIG. 2, the heat exchanger 116 receives a high pressure natural gas feed stream 122 that is cooled and liquefied in the main heat exchanger via removal of heat via heat exchange with refrigeration streams. As a result, a product stream 124 of liquid natural gas (LNG) is produced.

A compression system provides mixed refrigerant streams to, and receives a mixed refrigerant stream 128 from, the heat exchanger 116 and conditions the mixed refrigerant in the same manner as compression system 26 of FIG. 1.

As is known in the art, the CWHX heat exchanger 116 includes a shell 132 that receives the conditioned mixed refrigerant streams 134, 136, 138 and 140. Mixed refrigerant stream 134 is formed by cooling and expanding the vapor stream 142 from the cold vapor separator 144. Mixed refrigerant stream 136 is formed by cooling and expanding the liquid stream 146 from the cold vapor separator 144. Mixed refrigerant stream 138 is formed by cooling and expanding the liquid stream 148 from the high pressure accumulator 152. Mixed refrigerant stream 140 is formed by cooling and expanding the liquid stream 154 from the interstage separation device 156.

The cooling passages 188*a* and 188*b* of the heat exchanger 116, and the passages used to cool the mixed refrigerant, are formed by tube bundles wrapped around a core or mandrel and positioned within the shell 132 of the heat exchanger. As a result, the exterior surfaces of the tube bundles are exposed to the mixed refrigerant streams 134, 136, 138 and 140 entering the shell.

Similar to the system and process of FIG. 1, the component removal system 12 receives a cooled gas feed stream 186, which is produced by cooling feed gas stream 122 in a first cooling passage 188*a* of the main heat exchanger 116. The cooled gas feed stream 186 is processed in the component removal system 12 in the same manner described above with reference to FIG. 1 and a compressed vapor stream 190 is returned to a second cooling passage 188*b* of the heat exchanger 116 to be liquefied so that LNG product stream 124 is produced.

Figure 3:
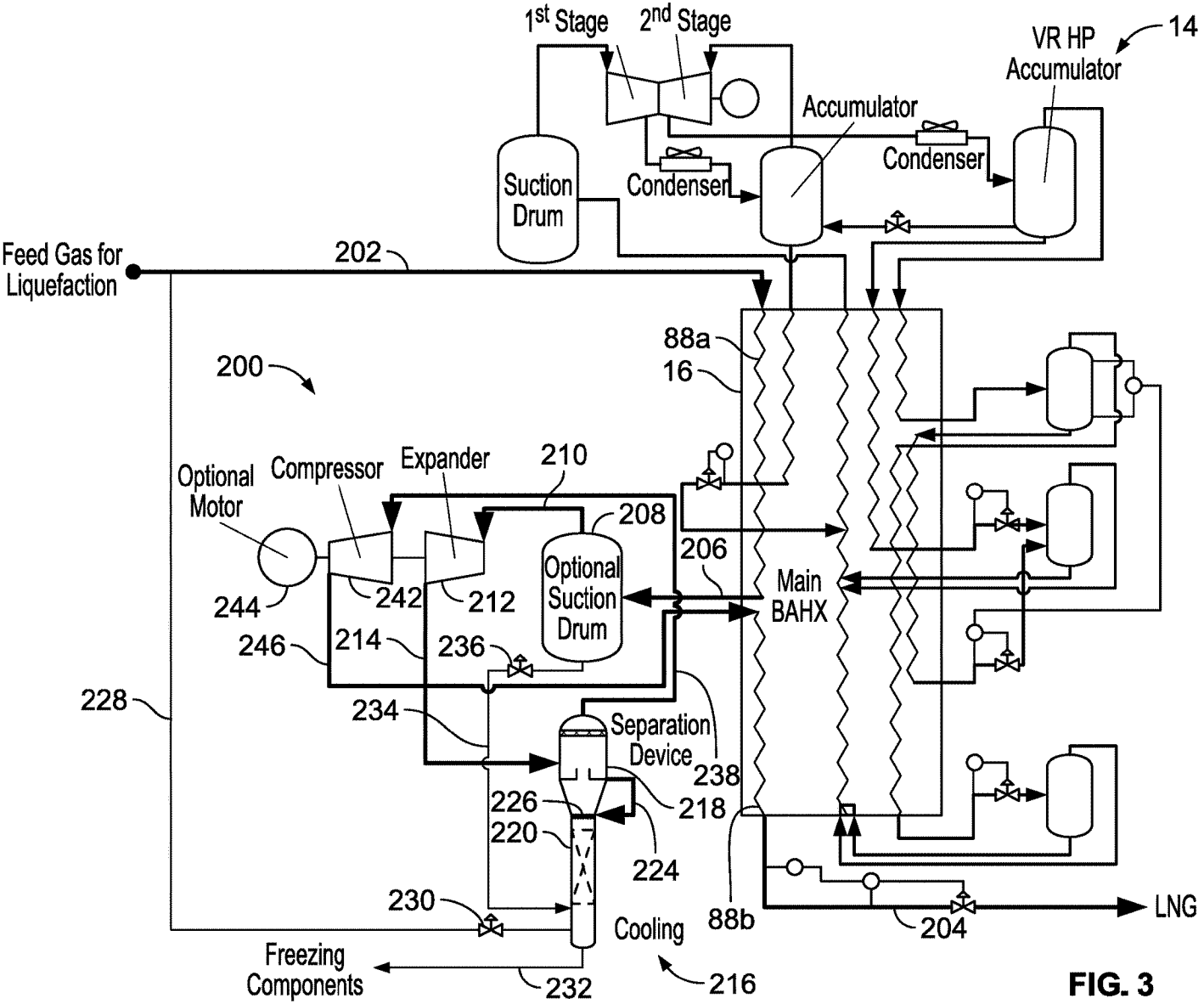
FIG. 3 is a process flow diagram and schematic illustrating a third embodiment of the system of the disclosure.

An alternative embodiment of the component removal system is indicated in general at 200 in FIG. 3. The liquefaction system 14 operates in the same manner as illustrated in FIG. 1 and therefore also includes a main heat exchanger 16 including first and second cooling passages 88*a* and 88*b*.

As explained below, the component removal system 200 of FIG. 3 uses a stripping gas to remove light components from the freezing components and other selected components so that the light components are added to the LNG product stream.

With reference to FIG. 3, and as in previous embodiments, a natural gas feed stream 202 is cooled and liquefied in the main heat exchanger 16 via removal of heat via heat exchange with refrigeration streams. As a result, a product stream 204 of liquid natural gas (LNG) is produced.

The component removal system 200 receives a cooled gas feed stream 206, which is produced by cooling feed gas stream 202 in the first cooling passage 88*a* of the main heat exchanger 16.

Cooled feed gas stream 206, after withdrawal from the main heat exchanger 16, is directed to an optional suction drum 208. A vapor stream 210 from the suction drum travels to an expander 212, which is preferably an expansion turbine, so that the gas stream pressure is reduced below the critical pressure. This causes the components that would freeze and/or other selected components that would condense in the main heat exchanger to condense so that a mixed-phase stream 214 is formed. While an expansion turbine is illustrated as the expander 212, alternative expansion devices including, but not limited to, expansion valves or orifices could be used.

This mixed-phase stream 214 travels to a separation column, indicated in general at 216. The column 216 includes a separation section 218 and a stripping section 220. As is known in the art, the stripping section 220 may include mesh pads, trays, packing and similar components.

Mixed-phase stream 214 enters the separation section 218 of the column and is separated into vapor and liquid portions. The liquid portion flows down into the stripping section 220 directly and/or through an internal or external distribution arrangement including, for example, distribution line 224 and distribution device 226.

A stripping gas is provided through stripping gas line 228 which directs a portion of the feed gas stream 202 to the bottom portion of the stripping section 220 under the control of valve 230. Alternatively, stripping gas may be withdrawn from stream 88*a* at a colder temperature.

A liquid stream 232 containing the condensed freezing components and other selected components is withdrawn from the bottom of the column 216.

Any liquid collected in the suction drum 208 may be directed to the stripping section 220 of column 216 by opening a drain valve 236 in a liquid line 234 exiting the bottom of the suction drum. This prevents potential damage to the expander 212.

The suction drum 208, and thus liquid line 234 and drain valve 236, is optional and thus may be omitted with the feed stream withdrawn from the main heat exchanger being routed directly to the inlet of the expander 212.

A purified methane-rich vapor stream 238 exits the top of the separation column 216 and is directed to a compressor 242, which may be powered by the expander 212 (in versions of the system where the expander is a turbine) or a motor 244, or a combination of both. By receiving the vapor stream at the temperature of the separation device, the compressor 242 "cold compresses" the vapor stream 238 to a higher pressure and a temperature, where the temperature of the compressed gas stream is ideally approximately equal to or slightly below the temperature of the vapor in the suction drum 208 or the cooled gas stream 206 withdrawn from the main heat exchanger. The outlet temperature of the vapor stream 246 exiting the compressor is near or below the temperature of the gas in the suction drum 208 (or stream 206) because the system does not heat the vapor exiting the separation column 216 prior to entry into the compressor 242. Furthermore, by having cold vapor enter the compressor 242, the pressure of the vapor exiting the compressor is higher than if the vapor from the separation column 216 was heated prior to entry into the compressor (for the same compressor power level). As a result, the refrigeration power required for a given level of liquid natural gas production is reduced or, conversely, a higher liquid natural gas production is obtained if the refrigeration power is fixed. The compressed vapor stream 246 is returned to the second cooling passage 88*b* of the heat exchanger 16 to be liquefied so that LNG product stream 204 is produced.

Figure 4:
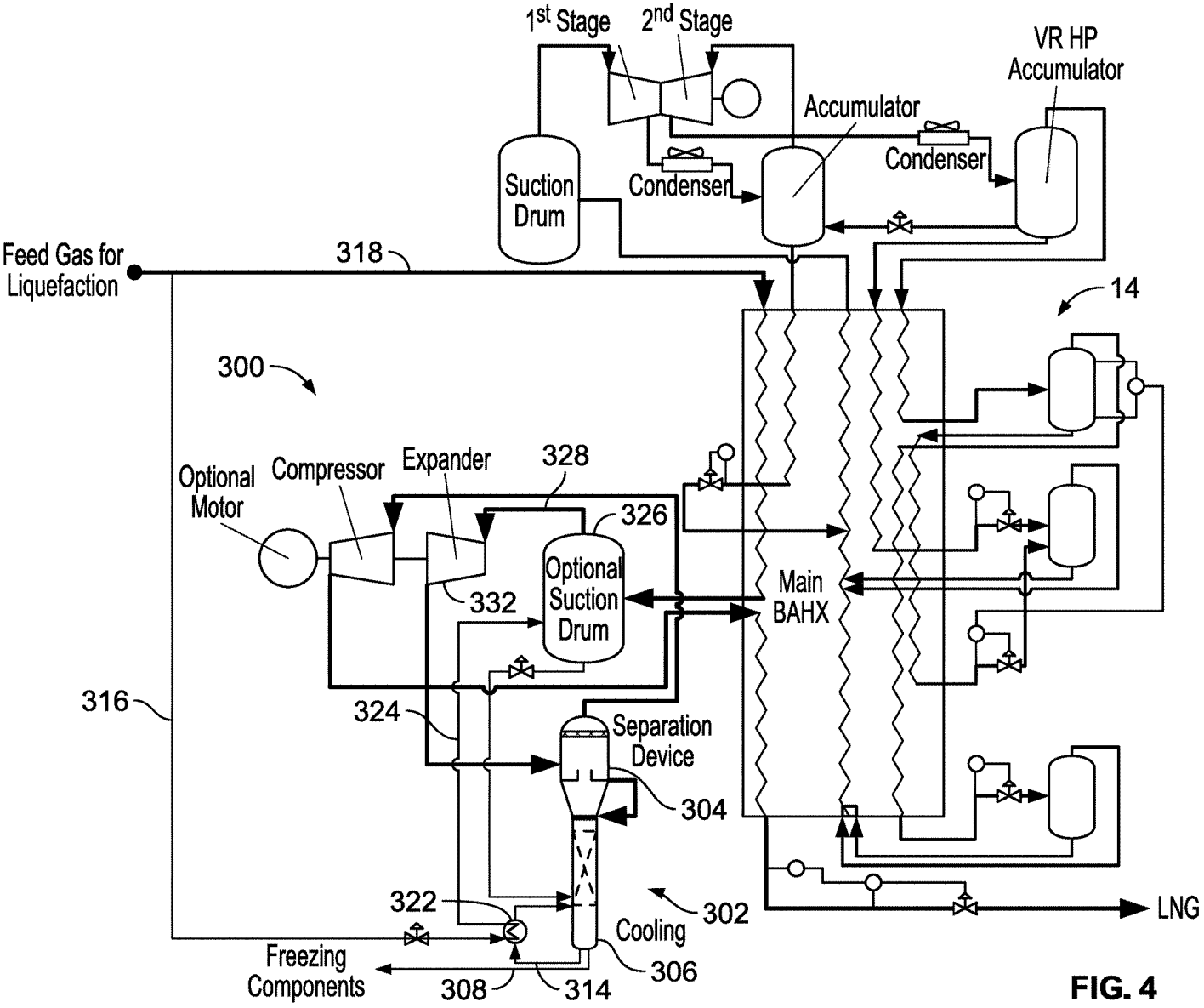
FIG. 4 is a process flow diagram and schematic illustrating a fourth embodiment of the system of the disclosure.

An alternative version of the system of FIG. 3, wherein a reboiler service has been added for the stripping section of the separation column, is presented in FIG. 4. More specifically, a component removal system, indicated in general at 300 in FIG. 4, includes a separation column 302 which features a separation section 304 and a stripping section 306. A liquid stream 308 containing the condensed freezing components and other selected components is withdrawn from the bottom of the column 302. In addition, a reboiler service including reboiler heat exchanger 322 receives a reboiler liquid stream 314 from the stripping section 306 of the column. Heat exchanger 322 also receives and cools a takeoff gas stream 316 that branches off of the primary natural gas feed stream 318 entering the liquefaction system. As a result, the liquid stream 314 from the column is at least partially vaporized and the resulting vapor stream is returned to the stripping section 306 of the column for use as a stripping gas. The cooled takeoff gas stream 324 exits the reboiler heat exchanger 322 and is directed to optional suction drum 326. In embodiments where the suction drum 326 is omitted, the cooled takeoff gas stream 324 may be combined with the vapor stream 328 that enters the expander 332. In an alternative embodiment, stream 316 may be replaced by a stream taken off of stream 88*a* (FIG. 1) or any other heating medium.

The remaining aspects of the contamination system 300, separation column 302 and the liquefaction system 14 of FIG. 4 operate in the same manner as described above with reference to FIG. 3

Figure 5:
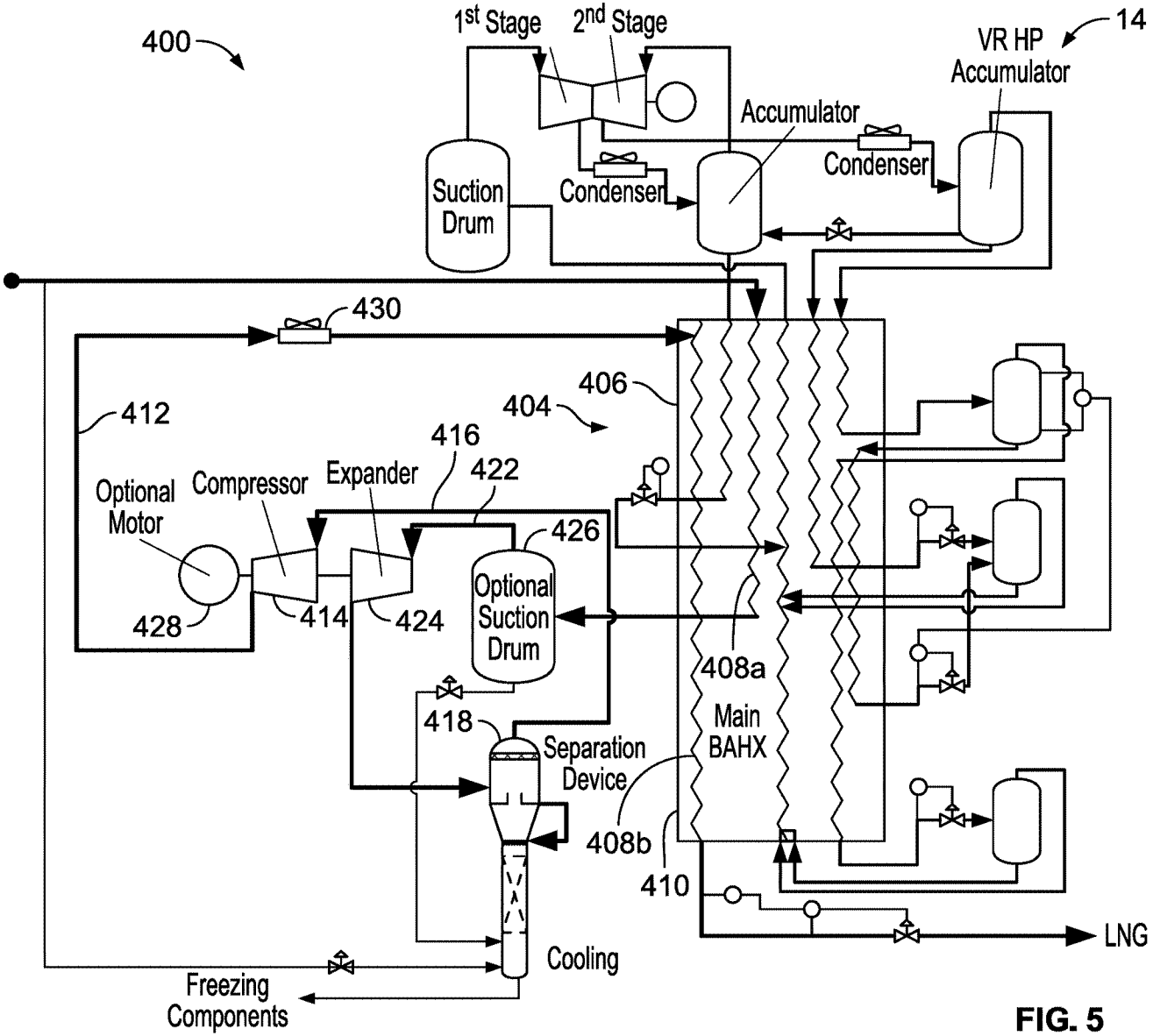
FIG. 5 is a process flow diagram and schematic illustrating a fifth embodiment of the system of the disclosure.

An alternative embodiment of the component removal system is indicated in general at 400 in FIG. 5. The liquefaction system 14 operates in the same manner as illustrated in FIG. 1. The remaining aspects of the system of FIG. 5 are the same as the system of FIG. 3 with the exception of the treatment of the outlet stream 412 of the compressor 414. The treatment of the compressor outlet stream of FIG. 5 may be used in any of the embodiments described above.

The system 400 includes a main heat exchanger 404 including a warm end portion 406, a cold end portion 410 and first and second cooling passages 408*a* and 408*b*. As illustrated in FIG. 5, the second cooling passage 408*b* is configured as a high pressure pass that passes at least partially through both the warm and cold end portions 406 and 410 of the heat exchanger.

In the embodiment of FIG. 5, the compressor suction remains at approximately the purified vapor temperature where, as in previous embodiments, the purified vapor temperature is the temperature of the vapor stream 416 exiting the top of the separation device 418. The discharge pressure of the compressor, and thus the pressure of stream 412, is increased (with respect to the embodiments described above) to the point where the stream 412 is warmer than the temperature of the stream 422 entering expander 424 (or optional suction drum 426). As a result, the gas stream 412 is warmer than in the previous embodiments, and thus the stream 412 is directed to the high pressure gas pass 408*b*. In this embodiment, power to the compressor by optional motor 428 may be required (either by itself or in addition to power provided by the expander turbine 424). In addition, an optional compressor discharge conditioning heat exchanger 430 may be provided to condition (which may be either cooling or heating) stream 412 and provide heat integration with the liquefaction, condensate system or other processes prior to entry into the heat exchanger.

The component removal system embodiments presented above recompress a gas from a separation device, wherein selected components are removed from the gas, without warming the gas such that the compressor suction is cold, that is, at the temperature of the separation device. Power required for compression and discharge temperature of the compressor are proportional to the suction temperature. Therefore, compressing cold allows the compressor discharge pressure to be higher and the temperature to be lower than if the suction was warmed first, with the fixed power available, and the desired return temperature and return pressure to the main heat exchanger. As a result, the refrigeration power required for a given level of liquid natural gas production is reduced or, conversely, a higher liquid natural gas production is obtained if the refrigeration power is fixed.

While the preferred embodiments of the invention have been shown and described, it will be apparent to those skilled in the art that changes and modifications may be made therein without departing from the spirit of the invention, the scope of which is defined by the appended claims.

What is claimed is:

1. A system for removing selected components from a gas stream comprising:

a. a heat exchanger including a first cooling passage configured to receive a feed gas stream and to provide a cooled feed gas stream;

b. an expander configured to receive at least a portion of the cooled feed gas stream;

c. a separation device having a separation device vapor outlet, said separation device configured to receive an expanded fluid stream from the expander and to separate the expanded fluid stream into a liquid stream containing selected components and a purified vapor stream having a purified vapor temperature; and d. a compressor configured to receive the purified vapor stream directly from the separation device vapor outlet at approximately the purified vapor temperature and to produce a compressed vapor stream that is returned to the heat exchanger, wherein the compressed vapor stream is compressed to a pressure corresponding to a temperature that is approximately equal to a temperature of the cooled gas stream.

2. The system of claim 1 further comprising a second cooling passage configured to receive the compressed vapor stream and wherein the heat exchanger includes a single main heat exchanger including the first and second cooling passages.

3. The system of claim 1 further comprising a second cooling passage configured to receive the compressed vapor stream and wherein the heat exchanger includes a first heat exchanger including the first cooling passage and a second heat exchanger including the second cooling passage.

4. The system of claim 1 further comprising a second cooling passage configured to receive the compressed vapor stream, a third cooling passage arranged in parallel with the first cooling passage so that the first and third cooling passages receive the feed gas stream and provide a cooled feed gas stream to the expander and a fourth cooling passage arranged in parallel with the second cooling passage so that the second and fourth cooling passages receive the compressed vapor stream.

5. The system of claim 4 wherein the first and second cooling passages are in a first heat exchanger and the third and fourth cooling passages are in a second heat exchanger.

6. The system of claim 1 further comprising a conditioning heat exchanger configured to receive compressed vapor from the compressor and to direct conditioned compressed vapor to the heat exchanger.

7. The system of claim 1 further comprising a suction drum configured to receive the cooled feed gas stream from the heat exchanger first cooling passage, said suction drum having a suction drum vapor outlet configured to direct at least a portion of the cooled feed gas stream to the expander.

8. The system of claim 7 wherein the suction drum has a suction drum liquid outlet and further comprising a liquid drain line configured to direct a fluid stream to the separation device.

9. The system of claim 1 wherein the expander is an expansion turbine and the compressor is powered by the expansion turbine.

10. The system of claim 1 wherein the separation device includes a separation column having a separation section and a stripping section wherein the separation section is configured to receive the expanded fluid stream from the expander, direct liquid to the stripping section and direct the purified vapor stream to the compressor and the contaminant liquid stream exits the stripping section;

and further comprising a stripping gas line configured to receive a portion of the feed gas stream and to direct the portion of the feed gas stream to the stripping section for use as a stripping gas.

11. The system of claim 10 wherein the stripping gas line includes an inlet configured to receive fluid from the first cooling passage of the heat exchanger.

12. The system of claim 10 further comprising a suction drum configured to receive the cooled feed gas stream from the heat exchanger first cooling passage, said suction drum having a suction drum vapor outlet configured to direct at least a portion of the cooled feed gas stream to the expander and a suction drum liquid outlet configured to direct a fluid stream to the stripping section.

13. The system of claim 1 wherein the separation device includes a separation column having a separation section and a stripping section wherein the separation section is configured to receive the expanded fluid stream from the expander, direct liquid to the stripping section and direct the purified vapor stream to the compressor and wherein the liquid stream containing the selected components exits the stripping section;

and further comprising:

a reboiler heat exchanger configured to receive a reboiler liquid stream from the stripping section to at least partially vaporize the reboiler liquid stream and to direct a resulting stripping gas stream to the stripping section.

14. The system of claim 13 further comprising a takeoff gas line configured to receive a portion of the feed gas stream and to direct the portion of the feed gas stream to the reboiler heat exchanger wherein the portion of the feed gas stream is cooled as the reboiler liquid stream is warmed and vaporized and wherein the reboiler heat exchanger is configured to direct at least a portion of the cooled portion of the feed gas stream to the expander.

15. The system of claim 1 further comprising a second cooling passage configured to receive the compressed vapor stream, wherein the first and second cooling passages are positioned within the heat exchanger in a parallel configuration.

16. The system of claim 15 wherein the heat exchanger includes a warm end portion and a cold end portion with the second cooling passage forming a high pressure pass that passes at least partially through both the warm and cold end portions of the heat exchanger and wherein the first cooling passage passes through at least a portion of the warm end portion of the heat exchanger.

17. The system of claim 16 further comprising a conditioning heat exchanger configured to receive compressed vapor from the compressor and to direct conditioned compressed vapor to the high pressure pass.

18. A system for liquefying a feed gas comprising:

a. a heat exchanger having a first cooling passage and a second cooling passage, said first cooling passage configured to receive a feed gas stream at a feed gas stream temperature so that a cooled feed gas stream is formed;

b. a mixed refrigerant compression system in communication with the heat exchanger and configured to cool the first and second cooling passages;

c. a liquefied gas outlet line connected to an outlet of the second cooling passage;

d. an expander configured to receive at least a portion of the cooled feed gas stream from the first cooling passage;

e. a separation device having a separation device vapor outlet, said separation device configured to receive an expanded fluid stream from the expander and to separate the expanded fluid stream into a liquid stream containing selected components and a purified vapor stream having a purified vapor temperature;

f. a compressor configured to receive the purified vapor stream directly from the separation device vapor outlet at approximately the purified vapor temperature and to produce a compressed vapor stream, wherein the compressed vapor stream is compressed to a pressure corresponding to a temperature that is approximately equal to a temperature of the cooled gas stream;

g. said second cooling passage configured to receive and liquefy the compressed vapor stream;

h. wherein the separation device includes a separation column having a separation section and a stripping section wherein the separation section is configured to receive the expanded fluid stream from the expander, direct liquid to the stripping section and direct the purified vapor stream to the compressor and wherein the liquid stream containing selected components exits the stripping section; and i. a stripping gas line configured to receive a vapor portion of the feed gas stream at the feed gas stream temperature and to direct the portion of the feed gas stream to the stripping section for use as a stripping gas.

19. The system of claim 18 wherein the heat exchanger includes a single main heat exchanger including the first and second cooling passages.

20. The system of claim 18 wherein the heat exchanger includes a first heat exchanger including the first cooling passage and a second heat exchanger including the second cooling passage.

21. The system of claim 18 further comprising a third cooling passage arranged in parallel with the first cooling passage so that the first and third cooling passages receive the feed gas stream and provide a cooled feed gas stream to the expander and a fourth cooling passage arranged in parallel with the second cooling passage so that the second and fourth cooling passages receive and liquefy the compressed vapor stream.

22. The system of claim 21 wherein the first and second cooling passages are in a first heat exchanger and the third and fourth cooling passages are in a second heat exchanger.

23. The system of claim 18 further comprising a conditioning heat exchanger configured to receive compressed vapor from the compressor and to direct conditioned compressed vapor to the heat exchanger.

24. The system of claim 18 further comprising a suction drum configured to receive the cooled feed gas stream from the heat exchanger first cooling passage, said suction drum having a suction drum vapor outlet configured to direct at least a portion of the cooled feed gas stream to the expander.

25. The system of claim 24 wherein the suction drum has a suction drum liquid outlet and further comprising a liquid drain line configured to direct a fluid stream to the separation device.

26. The system of claim 18 wherein the expander is an expansion turbine and the compressor is powered by the expansion turbine.

27. The system of claim 18 wherein the stripping gas line includes an inlet configured to receive fluid from the first cooling passage of the heat exchanger.

28. The system of claim 18 further comprising a suction drum configured to receive the cooled feed gas stream from the heat exchanger first cooling passage, said suction drum having a suction drum vapor outlet configured to direct at least a portion of the cooled feed gas stream to the expander and a suction drum liquid outlet configured to direct a fluid stream to the stripping section.

29. The system of claim 18 further comprising:

a reboiler heat exchanger configured to receive a reboiler liquid stream from the stripping section to warm and at least partially vaporize the reboiler liquid stream and to direct a resulting stripping gas stream to the stripping section; and a takeoff gas line configured to receive a portion of the feed gas stream and to direct the portion of the feed gas stream to the reboiler heat exchanger wherein the portion of the feed gas stream is cooled as the reboiler liquid stream is warmed and partially vaporized and wherein the reboiler heat exchanger is configured to direct at least a portion of the cooled portion of the feed gas stream to the expander.

30. The system of claim 18 wherein the heat exchanger includes a warm end portion and a cold end portion with the second cooling passage forming a high pressure pass that passes at least partially through both the warm and cold end portions of the heat exchanger and wherein the first cooling passage passes through at least a portion of the warm end portion of the heat exchanger.

31. The system of claim 30 further comprising a conditioning heat exchanger configured to receive compressed vapor from the compressor and to direct conditioned compressed vapor to the high pressure pass.

32. A method for removing selected components from a gas stream comprising the steps of:

a. cooling a feed gas stream to provide a cooled feed gas stream;

b. expanding the cooled feed gas stream to provide an expanded gas stream;

c. separating the expanded gas stream using a separation device having a separation device vapor outlet into a liquid stream containing selected components and a purified vapor stream having a purified vapor temperature; and d. compressing the purified vapor stream using a compressor after the compressor receives the purified vapor stream directly from the separation device vapor outlet at approximately the purified vapor temperature to provide a compressed vapor stream, wherein the compressed vapor stream is compressed to a pressure corresponding to a temperature that is approximately equal to a temperature of the cooled gas stream.

33. The method of claim 32 wherein the gas stream is a natural gas stream.

34. A method of liquefying a gas feed stream comprising the steps of:

a. cooling a gas feed gas stream to provide a cooled feed gas stream;

b. expanding the cooled feed gas stream to provide an expanded gas stream;

c. separating the expanded gas stream using a separation device having a separation device vapor outlet into a liquid stream containing selected components and a purified vapor stream having a purified vapor temperature;

d. compressing the purified vapor stream using a compressor after the compressor receives the purified vapor stream directly from the separation device vapor outlet at approximately the purified vapor temperature to provide a compressed vapor stream, wherein the compressed vapor stream is compressed to a pressure corresponding to a temperature that is approximately equal to a temperature of the cooled gas stream; and e. cooling the compressed vapor stream to form a liquefied gas stream.

35. The method of claim 34 wherein the gas stream is a natural gas stream.

* * * * *